US010977978B1

(12) United States Patent
Zheng

(10) Patent No.: US 10,977,978 B1
(45) Date of Patent: Apr. 13, 2021

(54) GOA CIRCUIT AND TFT SUBSTRATE

(71) Applicant: Shenzhen China Star Optoelectronics Semiconductor Display Technology Co., Ltd., Guangdong (CN)

(72) Inventor: Xuhuang Zheng, Guangdong (CN)

(73) Assignee: Shenzhen China Star Optoelectronics Semiconductor Display Technology Co., Ltd., Guangdong (CN)

( * ) Notice: Subject to any disclaimer, the term of this patent is extended or adjusted under 35 U.S.C. 154(b) by 0 days.

(21) Appl. No.: 16/652,433

(22) PCT Filed: Mar. 16, 2020

(86) PCT No.: PCT/CN2020/079465
§ 371 (c)(1),
(2) Date: Mar. 31, 2020

(30) Foreign Application Priority Data

Feb. 26, 2020 (CN) ..... 202010120563.X

(51) Int. Cl.
*G09G 3/20* (2006.01)

(52) U.S. Cl.
CPC ..... *G09G 3/20* (2013.01); *G09G 2300/0408* (2013.01); *G09G 2310/0264* (2013.01); *G09G 2330/026* (2013.01)

(58) Field of Classification Search
None
See application file for complete search history.

(56) References Cited

U.S. PATENT DOCUMENTS

2007/0296681 A1* 12/2007 Kim ..... G11C 19/184 345/100
2009/0303211 A1* 12/2009 Hu ..... G11C 19/28 345/204
2014/0192039 A1* 7/2014 Wang ..... G11C 19/28 345/213
2016/0284293 A1* 9/2016 Dai ..... G09G 3/36
2016/0372034 A1* 12/2016 Zhou ..... G11C 19/28
2018/0275804 A1* 9/2018 Huang ..... G06F 3/04184
2018/0301101 A1* 10/2018 Hu ..... G11C 19/28

* cited by examiner

*Primary Examiner* — Kent W Chang
*Assistant Examiner* — Benjamin Morales
(74) *Attorney, Agent, or Firm* — Mark M. Friedman

(57) ABSTRACT

A gate driver on array (GOA) circuit and a thin film transistor (TFT) substrate are provided. The GOA circuit includes a pull-up control module, a pull-up module, a pull-down module, a pull-down maintaining module, and a switch module. The switch module is configured to be turned off after a preset time delay when the pull-up module outputs a current-level scan signal at a high potential. The bootstrap module is configured to maintain a pull-up control signal at a high potential within the preset time delay of the switch module, and when the switch module is turned off, the bootstrap module cuts off a connection with the current-level scan signal.

18 Claims, 1 Drawing Sheet

GOA CIRCUIT AND TFT SUBSTRATE

This application claims the priority of Chinese Application No. 202010120563.X filed on Feb. 26, 2020 and titled "GOA CIRCUIT AND TFT SUBSTRATE", which is incorporated herein by reference in its entirety.

FIELD OF INVENTION

The present disclosure relates to the field of display panel technologies, and more particularly to a gate driver on array (GOA) circuit and a thin film transistor (TFT) substrate.

BACKGROUND OF INVENTION

Gate driver on array, referred to as GOA, is to use the existing thin film transistor liquid crystal display array manufacturing process to make a gate row scan drive signal circuit on an array substrate to realize a driving method of scanning gates row by row.

A GOA circuit in the prior art, a capacitor thereof is mounted between a pull-up control signal output by a pull-up control module and a scan signal output by a pull-up module. When the scan signal is at a high potential, the potential of the pull-up control signal is raised by capacitor bootstrapping, so that the potential output by the pull-up module during the output of the scan signal is sufficiently high. However, using the capacitor bootstrapping does not provide flexibility in controlling a bootstrap condition. This results in a large capacitive load at the output and reduces load carrying capacity of the GOA circuit.

SUMMARY OF INVENTION

Embodiments of the present invention provide a gate driver on array (GOA) circuit and a thin film transistor (TFT) substrate to solve issues of large capacitive load and poor load carrying capacity at an output end of an existing GOA circuit.

An embodiment of the present invention provides a gate driver on array (GOA) circuit comprising a plurality of cascaded GOA units, and each GOA unit comprises: a pull-up control module configured to output a pull-up control signal at a high potential according to a first clock signal and an upper-level scan signal when scanning is started; a pull-up module configured to output a current-level scan signal at a high potential according to a second clock signal and the pull-up control signal; a pull-down module configured to pull down the pull-up control signal and the current-level scan signal to a low potential when scanning is completed; a pull-down maintaining module configured to maintain the pull-up control signal and the current-level scan signal at a low potential; a switch module configured to be turned off after a preset time delay when the pull-up module outputs the current-level scan signal at a high potential; a bootstrap module configured to maintain the pull-up control signal at a high potential according to the current-level scan signal at a high potential within the preset time delay of the switch module, and when the switch module is turned off, the bootstrap module cuts off a connection with the current-level scan signal.

In an embodiment of the present invention, the switch module is further configured to be turned on when the pull-up control signal is at a low potential, the switch module continues to be turned on when the pull-up control signal is converted from a low potential to a high potential, and the switch module is switched from on to off after a preset time delay when the pull-up module outputs the current scan signal at a high potential.

In an embodiment of the present invention, the switch module comprises a capacitor and a first switch tube; the switch module is further configured to charge the capacitor when the pull-up control signal is at a low potential and the first switch tube is turned on, when the pull-up control signal is converted from a low potential to a high potential, the first switch tube continues to be turned on through the capacitor, and when the pull-up module outputs the current-level scan signal at a high potential, the first switch tube is switched from being turned on to being turned off after the preset time delay.

In an embodiment of the present invention, an end of the capacitor is connected to the pull-down maintaining module, another end of the capacitor is connected to a gate of the first switch tube, a source of the first switch tube is connected to the bootstrap module, and a drain of the first switch tube is connected to the current-level scan signal.

In an embodiment of the present invention, the bootstrap module comprises a bootstrap capacitor; an end of the bootstrap capacitor is connected to the pull-up control signal, and another end of the bootstrap capacitor is connected to the source of the first switch tube.

In an embodiment of the present invention, the pull-up control module comprises a second switch tube; a gate of the second switch tube is connected to the first clock signal, a source of the second switch tube is connected to the upper-level scan signal, and a drain of the second switch tube outputs the pull-up control signal.

In an embodiment of the present invention, the pull-up module comprises a third switch tube; a gate of the third switch tube is connected to the pull-up control signal, a source of the third switch tube is connected to the second clock signal, and a drain of the third switch tube outputs the current-level scanning signal.

In an embodiment of the present invention, the pull-down module comprises a fourth switch tube; a gate of the fourth switch tube is connected to the pull-down maintaining module, a source of the fourth switch tube is connected to the current-level scan signal, and a drain of the fourth switch tube is connected to a low-potential signal.

In an embodiment of the present invention, the pull-down maintaining module comprises a fifth switch tube, a sixth switch tube, and a seventh switch tube; a gate and a drain of the fifth switch tube are connected to a high-potential signal, and the drain of the fifth switch tube is connected to the capacitor, the gate of the fourth switch tube, a gate of the sixth switch tube, and a source of the seventh switch tube, a source of the sixth switch tube is connected to the pull-up control signal, a drain of the sixth switch tube is connected to a low-potential signal, a gate of the seventh switch tube is connected to the pull-up control signal, and a drain of the seventh switch tube is connected to a low-potential signal.

An embodiment of the present invention further provides a thin film transistor (TFT) substrate comprising a gate driver on array (GOA) circuit comprising a plurality of cascaded GOA units, and each GOA unit comprises: a pull-up control module configured to output a pull-up control signal at a high potential according to a first clock signal and an upper-level scan signal when scanning is started; a pull-up module configured to output a current-level scan signal at a high potential according to a second clock signal and the pull-up control signal; a pull-down module configured to pull down the pull-up control signal and the current-level scan signal to a low potential when scanning is completed; a pull-down maintaining module configured to maintain the pull-up control signal and the current-level scan signal at a low potential; a switch module configured to be turned off after a preset time delay when the pull-up module outputs the current-level scan signal at a high potential; a bootstrap module configured to maintain the pull-up control signal at a high potential according to the current-level scan signal at a high potential within the preset time delay of the switch module, and when the switch module is turned off, the bootstrap module cuts off a connection with the current-level scan signal.

In an embodiment of the present invention, the switch module is further configured to be turned on when the pull-up control signal is at a low potential, the switch module continues to be turned on when the pull-up control signal is converted from a low potential to a high potential, and the switch module is switched from on to off after a preset time delay when the pull-up module outputs the current scan signal at a high potential.

In an embodiment of the present invention, the switch module comprises a capacitor and a first switch tube; the switch module is further configured to charge the capacitor when the pull-up control signal is at a low potential and the first switch tube is turned on, when the pull-up control signal is converted from a low potential to a high potential, the first switch tube continues to be turned on through the capacitor, and when the pull-up module outputs the current-level scan signal at a high potential, the first switch tube is switched from being turned on to being turned off after the preset time delay.

In an embodiment of the present invention, an end of the capacitor is connected to the pull-down maintaining module, another end of the capacitor is connected to a gate of the first switch tube, a source of the first switch tube is connected to the bootstrap module, and a drain of the first switch tube is connected to the current-level scan signal.

In an embodiment of the present invention, the bootstrap module comprises a bootstrap capacitor; an end of the bootstrap capacitor is connected to the pull-up control signal, and another end of the bootstrap capacitor is connected to the source of the first switch tube.

In an embodiment of the present invention, the pull-up control module comprises a second switch tube; a gate of the second switch tube is connected to the first clock signal, a source of the second switch tube is connected to the upper-level scan signal, and a drain of the second switch tube outputs the pull-up control signal.

In an embodiment of the present invention, the pull-up module comprises a third switch tube; a gate of the third switch tube is connected to the pull-up control signal, a source of the third switch tube is connected to the second clock signal, and a drain of the third switch tube outputs the current-level scanning signal.

In an embodiment of the present invention, the pull-down module comprises a fourth switch tube; a gate of the fourth switch tube is connected to the pull-down maintaining module, a source of the fourth switch tube is connected to the current-level scan signal, and a drain of the fourth switch tube is connected to a low-potential signal.

In an embodiment of the present invention, the pull-down maintaining module comprises a fifth switch tube, a sixth switch tube, and a seventh switch tube; a gate and a drain of the fifth switch tube are connected to a high-potential signal, and the drain of the fifth switch tube is connected to the capacitor, the gate of the fourth switch tube, a gate of the sixth switch tube, and a source of the seventh switch tube, a source of the sixth switch tube is connected to the pull-up control signal, a drain of the sixth switch tube is connected to a low-potential signal, a gate of the seventh switch tube is connected to the pull-up control signal, and a drain of the seventh switch tube is connected to a low-potential signal.

Beneficial effect of embodiments of the present invention: the switch module is provided between the bootstrap module and an output end of the GOA circuit. When the pull-up module outputs the current-level scan signal at a high potential, the switch module is turned on after a preset time, so that the bootstrap module maintains the pull-up control signal at a high potential for the preset time when the switch module is turned on. When the switch module is turned off, a connection to the output end of the GOA circuit is cut off. This reduces a load at the output end of the GOA circuit and improves load capacity of the output end of the GOA circuit.

DESCRIPTION OF DRAWINGS

In order to explain the technical solution in the embodiments or the prior art more clearly, the accompanying drawings used in the description of the embodiments or the prior art will be briefly introduced below. Obviously, the drawings in the following description are only some embodiments of the present invention. For those of ordinary skill in the art, other drawings can be obtained according to the drawings without paying creative efforts.

DETAILED DESCRIPTION OF PREFERRED EMBODIMENTS

Figure 1:
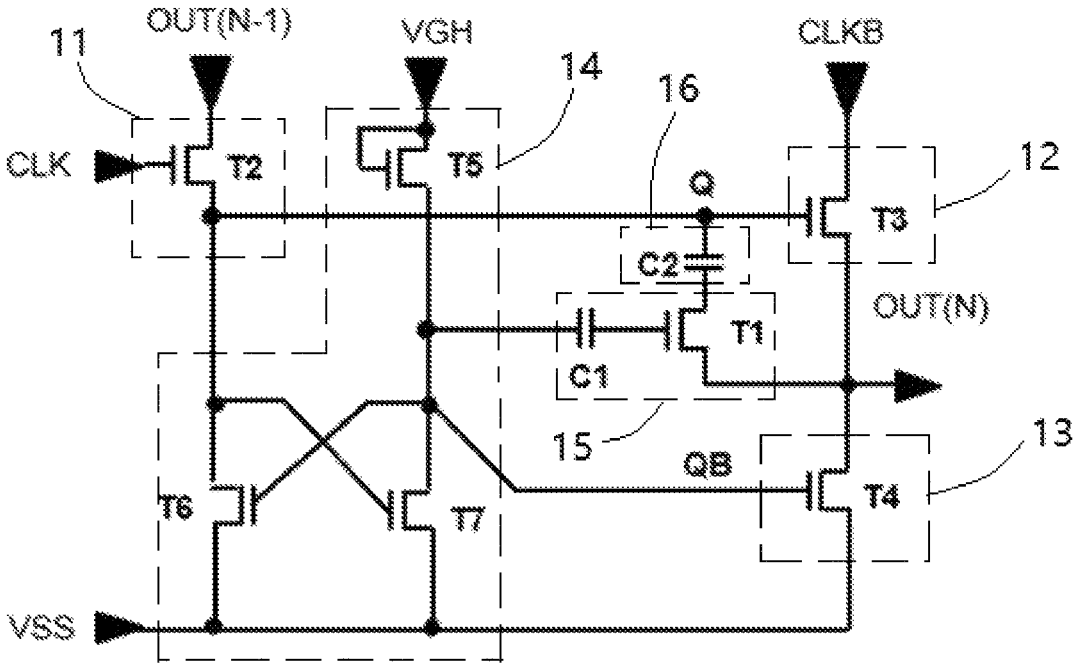
FIG. 1 is a schematic structural diagram of a gate driver on array (GOA) circuit according to an embodiment of the present invention.

The following descriptions of the embodiments are made with reference to additional illustrations to illustrate specific embodiments in which the present invention can be implemented. The directional terms mentioned in the present invention, such as up, down, front, back, left, right, inside, outside, side, etc., are only directions referring to the accompanying drawings. Therefore, the directional terms used are for explaining and understanding the present invention, but not for limiting the present invention. In the figures, similarly structured units are denoted by the same reference numerals.

Referring to FIG. 1, which is a schematic structural diagram of a gate driver on array (GOA) circuit according to an embodiment of the present invention.

A GOA circuit provided by an embodiment of the present invention includes a plurality of cascaded GOA units. Each GOA unit includes a pull-up control module 11, a pull-up module 12, a pull-down module 13, a pull-down maintaining module 14, a switch module 15, and a bootstrap module 16.

The pull-up control module 11 is configured to output a pull-up control signal Q at a high potential according to a first clock signal CLK and an upper-level scan signal OUT (N−1) when scanning is started.

In this embodiment, when the scanning is started, the pull-up control module 11 inputs first clock signal CLK at a high potential and the upper-level scan signal OUT (N−1) at a high potential. The pull-up control module 11 is turned on and outputs the pull-up control signal Q at a high potential. When the scanning is completed, the pull-up control module 11 inputs first clock signal CLK at a high potential and the upper-level scan signal OUT (N−1) at a low potential. The pull-up control module 11 is turned on and outputs the pull-up control signal Q at a low potential. The pull-up control signal Q can be used to control on and off of the pull-up module 22.

Specifically, the pull-up control module 11 includes a second switch tube T2.

A gate of the second switch tube T2 is connected to the first clock signal CLK, a source of the second switch tube T2 is connected to the upper-level scan signal OUT (N−1), and a drain of the second switch tube T2 outputs the pull-up control signal Q.

It should be noted that, when scanning is started, the gate of the second switch tube T2 inputs the first clock signal CLK at a high potential. The source of the second switch tube T2 receives the upper-level scan signal OUT (N−1) at a high potential. The second switch tube T2 is turned on, and the drain of the second switch tube T2 outputs the pull-up control signal Q at a high potential. Then, the gate of the second switch tube T2 inputs the first clock signal CLK at a low potential. The source of the second switch tube T2 inputs the upper-level scan signal OUT (N−1) at a low potential. The second switch tube T2 is turned off, and the pull-up control signal Q is in a floating state. When the scanning is completed, the gate of the second switch tube T2 inputs the first clock signal CLK at a high potential. The source of the second switch tube T2 inputs the upper-level scan signal OUT (N−1) at a low potential. The second switch tube T2 is turned on, and the drain of the second switch tube T2 outputs the pull-up control signal Q at a low potential. The second switch tube T2 may be a thin film transistor.

The pull-up module 12 is connected to the pull-up control module 11 and is configured to output a current-level scan signal OUT (N) at a high potential according to the second clock signal CLKB and the pull-up control signal Q.

In this embodiment, the pull-up control signal Q output by the pull-up control module 11 is input to the pull-up module 12. The pull-up module 12 inputs the second clock signal CLKB, so that the pull-up module 12 outputs the input second clock signal CLKB as the current-level scan signal OUT (N) according to the pull-up control signal Q. Specifically, when the pull-up module 12 inputs the pull-up control signal Q at a high potential and the second clock signal CLKB at a high potential, the pull-up module 12 outputs the current-level scan signal OUT (N) at a high potential. When the pull-up module 12 inputs the pull-up control signal Q at a high potential and the second clock signal CLKB at a low potential, the pull-up module 12 outputs the current-level scan signal OUT (N) at a high potential. The second clock signal CLKB is opposite to the first clock signal CLK.

Specifically, the pull-up module includes a third switch T3.

A gate of the third switch tube T3 is connected to the pull-up control signal Q, a source of the third switch tube T3 is connected to the second clock signal CLKB, and a drain of the third switch tube T3 outputs the current-level scan signal OUT (N).

It should be noted that the gate of the third switch tube T3 is input with the pull-up control signal Q at a high potential. The source of the third switch tube T3 inputs the second clock signal CLKB at a low potential. The third switch tube T3 is turned on, and the drain of the third switch tube T3 outputs the current-level scan signal OUT (N) at a high potential. The gate of the third switch tube T3 receives the pull-up control signal Q at a high potential. The source of the third switch tube T3 receives the second clock signal CLKB at a high potential. The third switch tube T3 is turned on, and the drain of the third switch tube T3 outputs the current-level scan signal OUT (N) at a high potential. The third switch tube T3 may be a thin film transistor. A terminal of the third switch tube T3 that outputs the current-level scan signal OUT (N) of is an output end of the GOA circuit.

The pull-down module 13 is respectively connected to the pull-up module 12 and the pull-down maintaining module 14, and is configured to pull down the pull-up control signal Q and the current-level scan signal OUT (N) to a low potential when scanning is completed.

In this embodiment, during the scanning process, the pull-down module 13 is turned off. When the scanning is completed, the pull-up control signal Q is pulled down to a low potential, the pull-down module 13 is turned on, and the current-level scan signal OUT (N) is pulled down to a low potential.

Specifically, the pull-down module 13 includes a fourth switch T4.

A gate of the fourth switch tube T4 is connected to the pull-down maintaining module 15, a source of the fourth switch tube T4 is connected to the current-level scan signal OUT (N), and a drain of the fourth switch tube T4 is connected to a low potential signal VSS.

It should be noted that during the scanning process, the pull-up control signal Q is at a high potential, and the gate of the fourth switch tube T4 is input with a control signal QB that is opposite to the pull-up control signal Q. That is, the gate of the fourth switch tube T4 inputs the control signal QB at a low potential. The fourth switch tube T4 is in an off state. When the scanning is completed, the pull-up control signal Q is pulled down to a low potential. The gate of the fourth switch tube T4 receives the control signal QB at a high potential. The source of the fourth switch tube T4 inputs the current-level scan signal OUT (N). The drain of the fourth switch tube T4 is connected to the low-potential signal VSS. The fourth switch tube T4 is turned on and pulls down the current-level scan signal OUT (N) to a low potential. The fourth switch tube T4 may be a thin film transistor.

The pull-down maintaining module 14 is respectively connected to the pull-down module 13 and the pull-up control module 11, and is configured to maintain the pull-up control signal Q and the current-level scan signal OUT (N) at a low potential.

In this embodiment, during the scanning process, the pull-up control signal Q is at a high potential, and the pull-down maintaining module 14 outputs the control signal QB at a low potential to the pull-down module 13, so that the pull-down module 13 is in an off state. When the scan is completed, the pull-up control signal Q is at a low potential, and the pull-down maintaining module 14 outputs the control signal QB at a high potential to the pull-down module 13 to turn on the pull-down module 13, such that the pull-up control signal Q and the current-level scan signal OUT (N) are maintained at a low potential.

Specifically, the pull-down maintaining module 14 includes a fifth switch tube T5, a sixth switch tube T6, and a seventh switch tube T7.

A gate and a drain of the fifth switch tube T5 are connected to a high-potential signal VGH. A drain of the fifth switch tube T5 is connected to the switch module 15, the gate of the fourth switch tube T4, a gate of the sixth switch tube T6, and a source of the seventh switch tube T7, respectively. A source of the sixth switch tube T6 is connected to the pull-up control signal Q. A drain of the sixth switch tube T6 is connected to the low-potential signal VSS. A gate of the seventh switch tube T7 is connected to the pull-up control signal Q. A drain of the seventh switch tube T7 is connected to the low-potential signal VSS.

It should be noted that when the pull-up control signal Q is at a high potential, the seventh switch tube T7 is turned on to pull down the control signal QB to the low-potential signal VSS. The sixth switch tube T6 is turned off, and the fourth switch tube T4 is turned off. When the pull-up control signal Q is at a low potential, the seventh switch tube T7 is turned off, the control signal QB is at a high-potential signal VGH, and the sixth switch tube T6 is turned on to maintain the pull-up control signal Q at a low potential. The fourth switch tube T4 is controlled to be turned on, and the current-level scan signal OUT (N) is pulled down and maintained at a low potential. The fifth switch tube T5, the sixth switch tube T6, and the seventh switch tube T7 are all thin film transistors.

The switch module 15 is connected to the pull-down maintaining module 14, the bootstrap module 16, and the pull-up module 12, respectively, and is configured to be turned off after a preset time delay when the pull-up module 12 outputs the current-level scan signal OUT (N) at a high potential.

Specifically, the switch module 15 is specifically configured to be turned on when the pull-up control signal Q is at a low potential. The switch module 15 continues to be turned on when the pull-up control signal Q is changed from a low potential to a high potential. When the switch module 15 and the pull-up module 12 output the current-level scan signal OUT (N) at a high potential, the switch module 15 is switched from on to off after the preset time delay.

In this embodiment, before the scanning is started and after the scanning is completed, the pull-up control signal Q is at a low potential, and the switch module 15 is in an on state. When scanning is started, the pull-up control module 11 outputs the pull-up control signal Q at a high potential. That is, the pull-up control signal Q is converted from a low potential to a high potential at this time. The switch module 15 is not turned off immediately, but is switched from on to off after a delay. During the delay period, the pull-up module 12 outputs the current-level scan signal OUT (N) at a high potential. That is, after the pull-up module 12 outputs the current-level scan signal OUT (N) at a high potential, the switch module 15 is still turned off after the preset time delay. After the switch module 15 is turned off, the pull-up control signal Q remains high. When the scanning is completed, the pull-up control signal Q is pulled down to a low potential, and the switch module 15 is switched to an on state again.

Specifically, the switch module 15 includes a capacitor C1 and a first switch tube T1.

The switch module 15 is specifically configured to charge the capacitor C1 when the pull-up control signal Q is at a low potential. The first switch T1 is turned on. When the pull-up control signal Q is converted from a low potential to a high potential, the first switch T1 continues to be turned on through the capacitor C1. When the pull-up module 12 outputs the current level scanning signal OUT (N) at a high potential, the first switch T1 is switched from on to off after the preset time delay.

An end of the capacitor C1 is connected to the drain of the fifth switch tube T5, and another end of the capacitor C1 is connected to the gate of the first switch tube T1. A source of the first switch tube T1 is connected to the bootstrap module 16, and a drain of the first switch tube T1 is connected to the current-level scan signal OUT (N).

The bootstrap module 16 is respectively connected to an output end of the pull-up control module 11 and the switch module 15. The bootstrap module 16 is configured to maintain the pull-up control signal Q at a high potential according to the current-level scan signal OUT (N) at a high potential within the preset time delay of the switch module 15. When the switch module 15 is turned off, the bootstrap module 16 cuts off the connection with the current-level scan signal OUT (N).

Specifically, the bootstrap module 16 includes a bootstrap capacitor C2.

An end of the bootstrap capacitor C2 is connected to the pull-up control signal Q, and another end of the bootstrap capacitor C2 is connected to the source of the first switch tube T1.

In this embodiment, an end of the bootstrap capacitor C2 is connected to an output end of the pull-up control module 11, and another end of the bootstrap capacitor C2 is connected to the output end of the pull-up module 12 through the switch module 15. When the output end of the pull-up module 12 outputs the current-level scan signal OUT (N) at a high potential, the switch module 15 is still in a conducting state within the preset time. The pull-up control signal Q at a high potential and the current-level scan signal OUT (N) at a high potential are connected across the bootstrap capacitor C2. The bootstrap capacitor C2 maintains the pull-up control signal Q at a high potential through bootstrapping. After the preset time delay, the switch module 15 is turned off, and the connection between the bootstrap capacitor C2 and the current-level scan signal OUT (N) is disconnected. The pull-up module 12 still outputs the current-level scan signal OUT (N) at a high potential, thereby reducing a capacitive load at the output end of the GOA circuit and improving loading capacity output by the GOA circuit.

Figure 2:
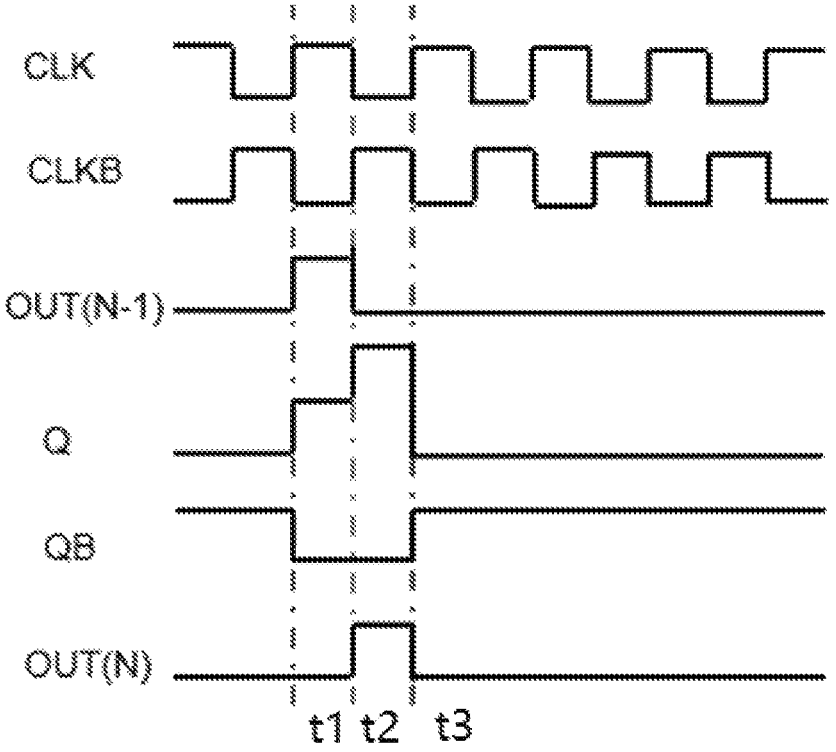
FIG. 2 is a timing diagram of signals in a GOA circuit according to an embodiment of the present invention.

The working principle of the GOA circuit provided by an embodiment of the present invention is described in detail below with reference to FIG. 1 and FIG. 2.

In a t1 phase, the first clock signal CLK at a high potential is input to the second switch tube T2 together with the upper-level scan signal OUT (N−1). The second switch tube T2 is turned on. The pull-up control signal Q at a high potential is output. The seventh switch tube T7 is turned on. The control signal QB is pulled to a low potential. The first switch tube T1 is still in a conducting state through the capacitor C1. The second clock signal CLKB at a low potential is input to the third switch tube T3. The third switch tube T3 is turned on. The current-level scan signal OUT (N) at a low potential is output.

In a t2 phase, the first clock signal CLK at a low potential is input to the second switch tube T2 together with the upper-level scan signal OUT (N−1). The second switch tube T2 is turned off, and the pull-up control signal Q is in a floating state. The second clock signal CLKB at a high potential is input to the third switch tube T3 to pull up the current-level scan signal OUT (N) to a high potential. The first switch tube T1 is turned on through the capacitor C1. The capacitor C1 maintains the pull-up control signal Q at a high potential. After a preset period of time, the first switch tube T1 is turned off, and the connection between the capacitor C1 and the current-level scan signal OUT (N) is cut off.

At a t3 phase, the first clock signal CLK at a high potential and the upper-level scan signal OUT (N−1) at a low potential are input to the second switch tube T2. The second switch tube T2 is turned on, and the pull-up control signal Q is pulled down to a low potential. The seventh switch tube T7 is turned off. The sixth switch tube T6 is turned on, and the control signal QB is pulled up to a high potential. The first switch tube T1 is turned on, and the fourth switch tube T4 is turned on, and pulls down the current-level scan signal OUT (N) to a low potential, and maintains the pull-up control signal Q and the current-level scan signal OUT (N) at a low potential.

In one embodiment, high and low potentials of the first clock signal CLK are +20V and −10V, respectively. High and low potentials of the second clock signal CLKB are +20V and −10V, respectively. The potential of the low potential signal VSS is −10V, and the potential of the high potential signal VGH is +20V. In practical applications, the voltage of each signal can be evaluated and set according to the aspect ratio of each thin film transistor, the process, and electrical parameters of the device.

In the above, in the GOA circuit of the embodiments, the switch module is provided between the bootstrap module and an output end of the GOA circuit. When the pull-up module outputs the current-level scan signal at a high potential, the switch module is turned on after a preset time, so that the bootstrap module maintains the pull-up control signal at a high potential for the preset time when the switch module is turned on. When the switch module is turned off, a connection to the output end of the GOA circuit is cut off. This reduces a load at the output end of the GOA circuit and improves load capacity of the output end of the GOA circuit. This is extremely suitable for products with extremely high GOA output loads such as ultra-high resolution and refresh rate.

This embodiment also provides a thin film transistor (TFT) substrate including the GOA circuit in the above embodiment, which is not described in detail here.

The TFT substrate of the embodiments reduces a load at the output end of the GOA circuit and improves load capacity of the output end of the GOA circuit. This is extremely suitable for products with extremely high GOA output loads such as ultra-high resolution and refresh rate.

In summary, although the present invention has been disclosed as above with preferred embodiments, the above preferred embodiments are not intended to limit the present invention. Those skilled in the art can make various modifications and retouching without departing from the spirit and scope of the present invention. Therefore, the protection scope of the present invention is subject to the scope defined by the claims.

What is claimed is:

1. A gate driver on array (GOA) circuit, comprising:

a plurality of cascaded GOA units, and each GOA unit comprising:

a pull-up control module configured to output a pull-up control signal at a high potential according to a first clock signal and an upper-level scan signal when scanning is started;

a pull-up module configured to output a current-level scan signal at a high potential according to a second clock signal and the pull-up control signal;

a pull-down module configured to pull down the pull-up control signal and the current-level scan signal to a low potential when scanning is completed;

a pull-down maintaining module configured to maintain the pull-up control signal and the current-level scan signal at a low potential;

a switch module configured to be turned off after a preset time delay when the pull-up module outputs the current-level scan signal at a high potential;

a bootstrap module configured to maintain the pull-up control signal at a high potential according to the current-level scan signal at a high potential within the preset time delay of the switch module, and when the switch module is turned off, the bootstrap module cuts off a connection with the current-level scan signal.

2. The GOA circuit according to claim 1, wherein the switch module is further configured to be turned on when the pull-up control signal is at a low potential, the switch module continues to be turned on when the pull-up control signal is converted from a low potential to a high potential, and the switch module is switched from on to off after a preset time delay when the pull-up module outputs the current scan signal at a high potential.

3. The GOA circuit according to claim 2, wherein the switch module comprises a capacitor and a first switch tube;

the switch module is further configured to charge the capacitor when the pull-up control signal is at a low potential and the first switch tube is turned on, when the pull-up control signal is converted from a low potential to a high potential, the first switch tube continues to be turned on through the capacitor, and when the pull-up module outputs the current-level scan signal at a high potential, the first switch tube is switched from being turned on to being turned off after the preset time delay.

4. The GOA circuit according to claim 3, wherein an end of the capacitor is connected to the pull-down maintaining module, another end of the capacitor is connected to a gate of the first switch tube, a source of the first switch tube is connected to the bootstrap module, and a drain of the first switch tube is connected to the current-level scan signal.

5. The GOA circuit according to claim 4, wherein the bootstrap module comprises a bootstrap capacitor;

an end of the bootstrap capacitor is connected to the pull-up control signal, and another end of the bootstrap capacitor is connected to the source of the first switch tube.

6. The GOA circuit according to claim 1, wherein the pull-up control module comprises a second switch tube;

a gate of the second switch tube is connected to the first clock signal, a source of the second switch tube is connected to the upper-level scan signal, and a drain of the second switch tube outputs the pull-up control signal.

7. The GOA circuit according to claim 1, wherein the pull-up module comprises a third switch tube;

a gate of the third switch tube is connected to the pull-up control signal, a source of the third switch tube is connected to the second clock signal, and a drain of the third switch tube outputs the current-level scanning signal.

8. The GOA circuit according to claim 3, wherein the pull-down module comprises a fourth switch tube;

a gate of the fourth switch tube is connected to the pull-down maintaining module, a source of the fourth switch tube is connected to the current-level scan signal, and a drain of the fourth switch tube is connected to a low-potential signal.

9. The GOA circuit according to claim 8, wherein the pull-down maintaining module comprises a fifth switch tube, a sixth switch tube, and a seventh switch tube;

a gate and a drain of the fifth switch tube are connected to a high-potential signal, and the drain of the fifth switch tube is connected to the capacitor, the gate of the fourth switch tube, a gate of the sixth switch tube, and a source of the seventh switch tube, a source of the sixth switch tube is connected to the pull-up control signal, a drain of the sixth switch tube is connected to a low-potential signal, a gate of the seventh switch tube is connected to the pull-up control signal, and a drain of the seventh switch tube is connected to a low-potential signal.

10. A thin film transistor (TFT) substrate, comprising:

a gate driver on array (GOA) circuit comprising a plurality of cascaded GOA units, and each GOA unit comprising:

a pull-up control module configured to output a pull-up control signal at a high potential according to a first clock signal and an upper-level scan signal when scanning is started;

a pull-up module configured to output a current-level scan signal at a high potential according to a second clock signal and the pull-up control signal;

a pull-down module configured to pull down the pull-up control signal and the current-level scan signal to a low potential when scanning is completed;

a pull-down maintaining module configured to maintain the pull-up control signal and the current-level scan signal at a low potential;

a switch module configured to be turned off after a preset time delay when the pull-up module outputs the current-level scan signal at a high potential;

a bootstrap module configured to maintain the pull-up control signal at a high potential according to the current-level scan signal at a high potential within the preset time delay of the switch module, and when the switch module is turned off, the bootstrap module cuts off a connection with the current-level scan signal.

11. The TFT substrate according to claim 10, wherein the switch module is further configured to be turned on when the pull-up control signal is at a low potential, the switch module continues to be turned on when the pull-up control signal is converted from a low potential to a high potential, and the switch module is switched from on to off after a preset time delay when the pull-up module outputs the current scan signal at a high potential.

12. The TFT substrate according to claim 11, wherein the switch module comprises a capacitor and a first switch tube;

the switch module is further configured to charge the capacitor when the pull-up control signal is at a low potential and the first switch tube is turned on, when the pull-up control signal is converted from a low potential to a high potential, the first switch tube continues to be turned on through the capacitor, and when the pull-up module outputs the current-level scan signal at a high potential, the first switch tube is switched from being turned on to being turned off after the preset time delay.

13. The TFT substrate according to claim 12, wherein an end of the capacitor is connected to the pull-down maintaining module, another end of the capacitor is connected to a gate of the first switch tube, a source of the first switch tube is connected to the bootstrap module, and a drain of the first switch tube is connected to the current-level scan signal.

14. The TFT substrate according to claim 13, wherein the bootstrap module comprises a bootstrap capacitor;

an end of the bootstrap capacitor is connected to the pull-up control signal, and another end of the bootstrap capacitor is connected to the source of the first switch tube.

15. The TFT substrate according to claim 10, wherein the pull-up control module comprises a second switch tube;

a gate of the second switch tube is connected to the first clock signal, a source of the second switch tube is connected to the upper-level scan signal, and a drain of the second switch tube outputs the pull-up control signal.

16. The TFT substrate according to claim 10, wherein the pull-up module comprises a third switch tube;

a gate of the third switch tube is connected to the pull-up control signal, a source of the third switch tube is connected to the second clock signal, and a drain of the third switch tube outputs the current-level scanning signal.

17. The TFT substrate according to claim 12, wherein the pull-down module comprises a fourth switch tube;

a gate of the fourth switch tube is connected to the pull-down maintaining module, a source of the fourth switch tube is connected to the current-level scan signal, and a drain of the fourth switch tube is connected to a low-potential signal.

18. The TFT substrate according to claim 17, wherein the pull-down maintaining module comprises a fifth switch tube, a sixth switch tube, and a seventh switch tube;

a gate and a drain of the fifth switch tube are connected to a high-potential signal, and the drain of the fifth switch tube is connected to the capacitor, the gate of the fourth switch tube, a gate of the sixth switch tube, and a source of the seventh switch tube, a source of the sixth switch tube is connected to the pull-up control signal, a drain of the sixth switch tube is connected to a low-potential signal, a gate of the seventh switch tube is connected to the pull-up control signal, and a drain of the seventh switch tube is connected to a low-potential signal.

* * * * *